US005920850A

United States Patent [19]

Hunter et al.

[11] Patent Number: 5,920,850

[45] Date of Patent: Jul. 6, 1999

[54] METERING SYSTEM WITH AUTOMATIC RESETTABLE TIME LOCKOUT

[75] Inventors: Kevin D. Hunter, Stratford; Arno Muller, Westport, both of Conn.

[73] Assignee: Pitney Bowes Inc., Stamford, Conn.

[21] Appl. No.: 08/334,096

[22] Filed: Nov. 4, 1994

[51] Int. Cl.[6] ..... G07B 17/00

[52] U.S. Cl. ..... 705/405

[58] Field of Search ..... 235/375; 364/464.02, 364/464.03; 380/25; 705/401, 405

[56] References Cited

U.S. PATENT DOCUMENTS

| | | | |
|---|---|---|---|
| 3,792,446 | 2/1974 | McFiggins et al. | 364/462.02 |
| 3,978,457 | 8/1976 | Check, Jr. et al. | 364/464.02 |
| 4,097,923 | 6/1978 | Eckert, Jr. et al. | 364/464.02 |
| 4,710,883 | 12/1987 | Wilson et al. | 364/466 |
| 4,783,745 | 11/1988 | Brookner et al. | 364/464.02 |
| 4,811,234 | 3/1989 | Storace | 364/464.02 |
| 4,812,994 | 3/1989 | Taylor et al. | 364/464.02 |
| 5,077,792 | 12/1991 | Herring | 380/24 |
| 5,107,455 | 4/1992 | Haines et al. | 395/275 |
| 5,243,654 | 9/1993 | Hunter | 380/51 |
| 5,377,268 | 12/1994 | Hunter | 380/25 X |

FOREIGN PATENT DOCUMENTS

| | | |
|---|---|---|
| 0111313 | 6/1984 | European Pat. Off. . |
| 0194661 | 9/1986 | European Pat. Off. . |
| 0223130 | 5/1987 | European Pat. Off. . |
| 2251210 | 1/1992 | United Kingdom . |

*Primary Examiner*—Edward R. Cosimano
*Attorney, Agent, or Firm*—Angelo N. Chaclas; Charles G. Parks, Jr.; Melvin J. Scolnick

[57] ABSTRACT

A postage metering system is provided with a countdown time. The countdown timer issues a priority interrupt when the timer has timed out which interrupts the control system of the meter in such a manner as to hold the meter in reset preventing operation of the postage meter. The timer is reset to a fixed period upon each funds recharge after the meter has been placed in recharge mode but prior to exposure of the secure accounting memory to recharge information.

5 Claims, 8 Drawing Sheets

METERING SYSTEM WITH AUTOMATIC RESETTABLE TIME LOCKOUT

FIELD OF THE INVENTION

This invention relates to metering devices and, more particularly, to a method of providing a time lockout and for resetting the time lockout in metering in continuous use.

BACKGROUND OF THE INVENTION

Various types of metering devices are known. One example is the electronic postage meter as, for instance, described in U.S. Pat. No. 3,978,457 to Check et al. As is well known, postage meters include an ascending register, that stores a running total of all postage dispensed by the meter, and a descending register, that holds the remaining amount of postage credited to the meter and that is reduced by the amount dispensed each time postage is printed by the meter. Because U.S. Postal Service regulations requires that postage be paid in advance, it had traditionally been required that the user of a postage meter periodically present the meter to a Postal Service employee for recharging. At the time of recharging, the user pays to the Postal Service an amount of postage to be credited to the meter and the postal employee credits or recharges the meter that amount paid by increasing the setting of the descending register by that amount. As the meter was used to dispense postage (by printing meter stamps on envelopes or labels), the setting of the descending register was reduced until either the meter was again recharged, or the setting reached zero or a pre-established figure near zero, at which point the meter was automatically locked, and thereby prevented from printing further meter stamps, until the meter was recharged. This locking feature is sometimes referred to as a "credit lockout", signifying that the meter is disabled upon exhaustion of the previously credited amount.

Another method of recharging postage meters while still satisfying Postal Service regulatory requirements has been developed and is described, for example in U.S. Pat. No. 3,792,446 to McFiggans et al., entitled "Remote Postage Meter Resetting Method". As described in the McFiggans et al. patent, a postage meter includes a combination lock that inhibits recharging of the meter. The required combination randomly changes each time the lock is opened. The user of the postage meter maintains an account with a credit balance. A central data center maintains a record of the user's account. When the user wishes to recharge the meter, he places a telephone call to the data center. The data center, using a voice answer back system, obtains identifying information from the user, verifies the information and checks to see that the user has sufficient funds in his account to cover the postage to be credited to the meter. The data center then provides a combination to the user that will allow the meter to be credited with a pre-determined amount of postage. At the same time, the center debits that amount from the user's account. The user enters into the postage meter the combination received from the data center. The meter is then unlocked so that the user can increment the descending register by the predetermined amount.

The remote recharging method described by McFiggans et al. was implemented with great success. A subsequent adaptation and improvement of this method is described in U.S. Pat. No. 4,097,923 to Eckert et al. The system of Eckert et al. is operable with a microcomputer controlled postage meter and allows the user to select a variable amount of postage with which the meter is to be credited. In the Eckert et al. system, the user advises the data center of the selected amount of postage and the data center provides a combination that reflects the selected amount of postage. The user enters the selected amount and the combination into the meter, which makes its own calculation of a combination into the meter, which makes its own calculation of a combination based upon the entered amount. The calculated combination is compared to the entered combination and if the two are consistent, the descending register is incremented by the entered amount.

In contrast to the U.S. Postal Service, the postal authorities of some foreign countries do not require prepayment of postage in all cases. In those countries, postage meters are not required to have the credit lockout feature. Postage meters of the type previously described herein may be adapted for use in those countries by, for example, eliminating the mechanism that locks the meter when the descending register reaches its minimum reading, or by omitting the descending register entirely, or by setting the descending register to a very high reading, or by allowing the user to reset the descending register whenever necessary. However, since postage is not prepaid, arrangements must be made for payments after the fact. Typically these arrangements include presentation of the meter for reading by a postal employee with payment in response to billing based on the meter reading.

A postage meter, in many respects, is equivalent to a currency printing device, it is a principle concern of the respective postal authorities that the manufacturer keep track of all meters in use and to be able to identify lost or stolen postage meters. In order to attempt to prevent their unauthorized use, U.S. Pat. No. 5,243,654 to Hunter describes a time lockout system which engages after the elapse of a given period of time. Hunter describes (a) a metering system which includes a dispensing or printing system for dispensing an accounting quantity of postage; (b) an accounting system for updating and storing information that represents the amount of postage dispensed by the printing mechanism; (c) a user interface system, e.g., keyboard and display, connected to the accounting mechanism for outputting the stored information; (d) a non-volatile memory for storing a time deadline; (e) a calendar clock mechanism for providing a signal that represents the current date; (f) a locking mechanism connected to the printer mechanism, the calendar clock mechanism and the non-volatile memory unit, for disabling the printing mechanism when the current date is not earlier than the time deadline; and (g) a deadline reset mechanism connected to the storage mechanism for extending the stored time deadline.

The deadline reset mechanism requires receiving a verification signal and comparing the verification signal with the stored accounting information. The deadline reset mechanism extends the stored time deadline if the verification signal is in accordance with the stored accounting information. The verification signal includes a deadline-extending combination to the user. The combination is inputted into the meter and results in extending the stored time deadline. The system as presented in Hunter presents several issues in the international marketplace. One such issue is the need for a data center and for meters to have remote resetting capability. In certain regions of the international market, it is logistically difficult to provide the necessary infrastructure to support remote meter resetting. Another concern with the Hunter system is related to the condition of exposing the accounting register to a possible fault condition as a result of requiring the entry of a deadline-extending combination necessitating access to the secure non-volatile accounting memories.

SUMMARY OF THE INVENTION

It is an objective of the present invention to present an improved postage meter time lockout system whereby the secure accounting memories, i.e., the non-volatile memories, are not independently accessed in order to extend the time deadline and thereby are not exposing the secure memories to an addition fault possibility.

It is a further objective of the present invention to present an improved postage memory time lockout system which is resettable without requiring the meter to have remote resettable capability.

A digital printing postage meter is comprised of a microprocessor control system which is in bus communication with a program read only memory (ROM), a number of secure non-volatile memories and an application specific integrated circuit (ASIC). The ASIC includes a number of modules which provide a number of system functions including a print control module. The ASIC has an internal bus which is in communication with a battery backed decrementing timer. This timer is reset to a fixed period whenever a reset mode is initiated prior to accessing the secure accounting memories. The reset mode can be initiated either by actuating the reset switch for a manual reset by postal authorities or electronically simply by placing the meter in the recharge mode.

Should the timer time-out, a priority one interrupt signal is sent to the interrupt controller of the ASIC which causes the meter to stop operating until the time is reset. Thereafter, the meter must be presented to the postal authorities or the manufacturer to be re-enabled once the meter has timed out.

DETAILED DESCRIPTION OF THE PREFERRED EMBODIMENT

Figure 1:
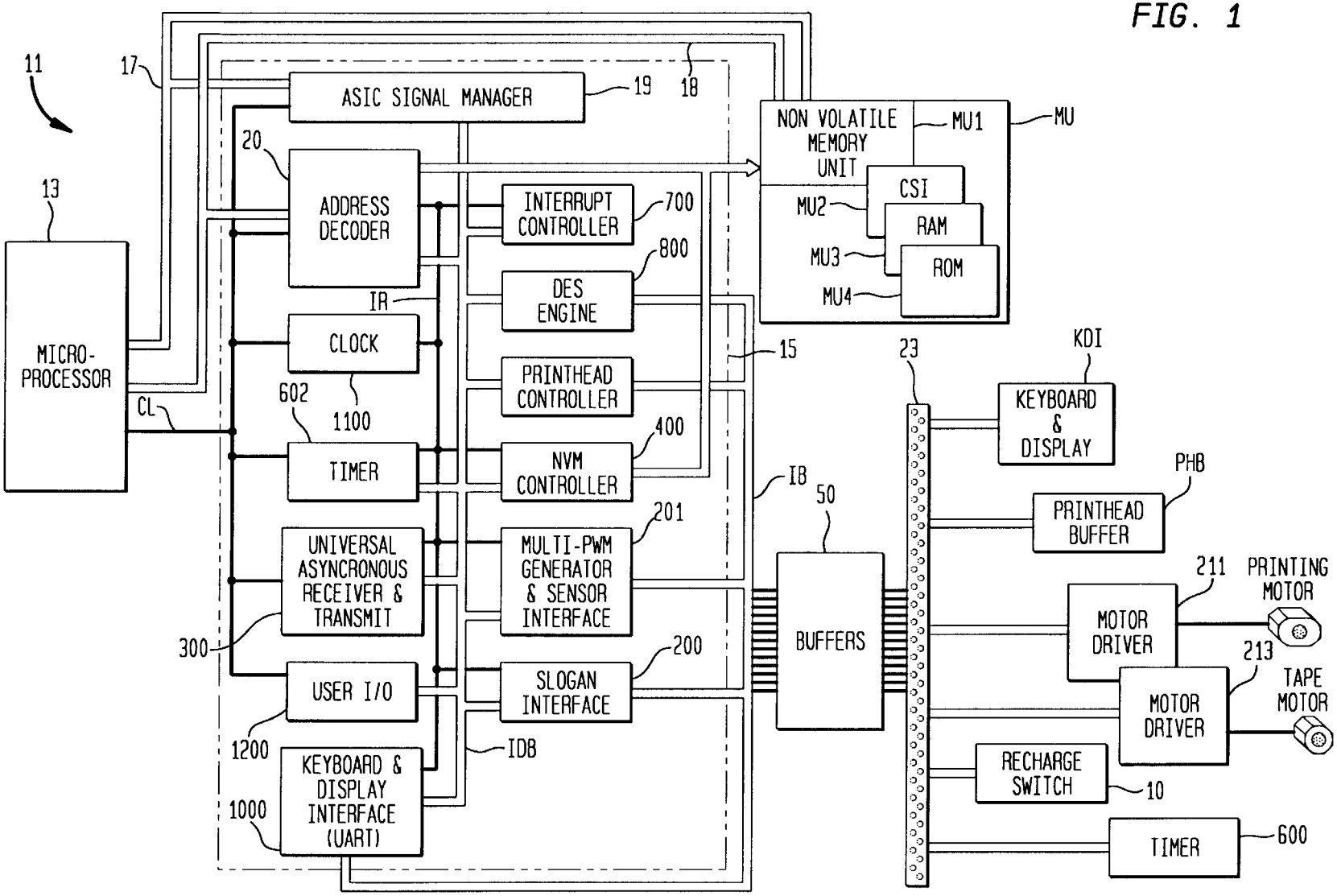
FIG. 1 is a schematic diagram of a postage metering control system in accordance with the present invention.

Referring to FIG. 1, a microprocessor control system, generally indicated as 11, which is preferably intended to control a thermal printing postage meter (not shown), is comprised of a microprocessor 13 in bus 17 and 18 communication with an ASIC 15 and a plurality of memory units (MU). The memory units MU include secure non-volatile memory MU1, memory MU42 random access memory MU3 and program memory MU4. Memory MU2 contains memory unit CS1 which is illustrative of any memory unit of an external device (not shown) which is in communication with the system bus 17 and 18. The ASIC 15 is comprised of a number of integrated circuits modules, for example, ASIC signal manager 19, address decoder 20, clock 1100, timer module 602, UART module 300, user I/O 1200, keyboard and display interface 1000, interrupt control 700, encryption and decryption engine 800, memory controller 400, multi-PWM generator and sensor interface 201 and a slogan interface 200. It should be appreciated that it is within the contemplation of the present invention that the IC modules which make up the ASIC 15 may vary and the modules here identified are intended to illustrate the preferred embodiment of the invention.

The ASIC has an internal data bus (IDB) and a plurality of control lines one group of which control lines are module interrupt lines IR. Another group of control lines CL provide a means for providing control signal from the microprocessor 13 to the ASIC 15. Certain of the modules are in communication with a coupler 23. The coupler 23 is in communication with various meter devices, such as, recharge switch 10, timer 600, the keyboard display KDI, print head buffer PHB and motor drivers 211 and 213. In FIG. 1, the bus lines IDB and IB, and control lines IR and CL are depicted in simplified manner for the purpose of clarity.

Figure 2:
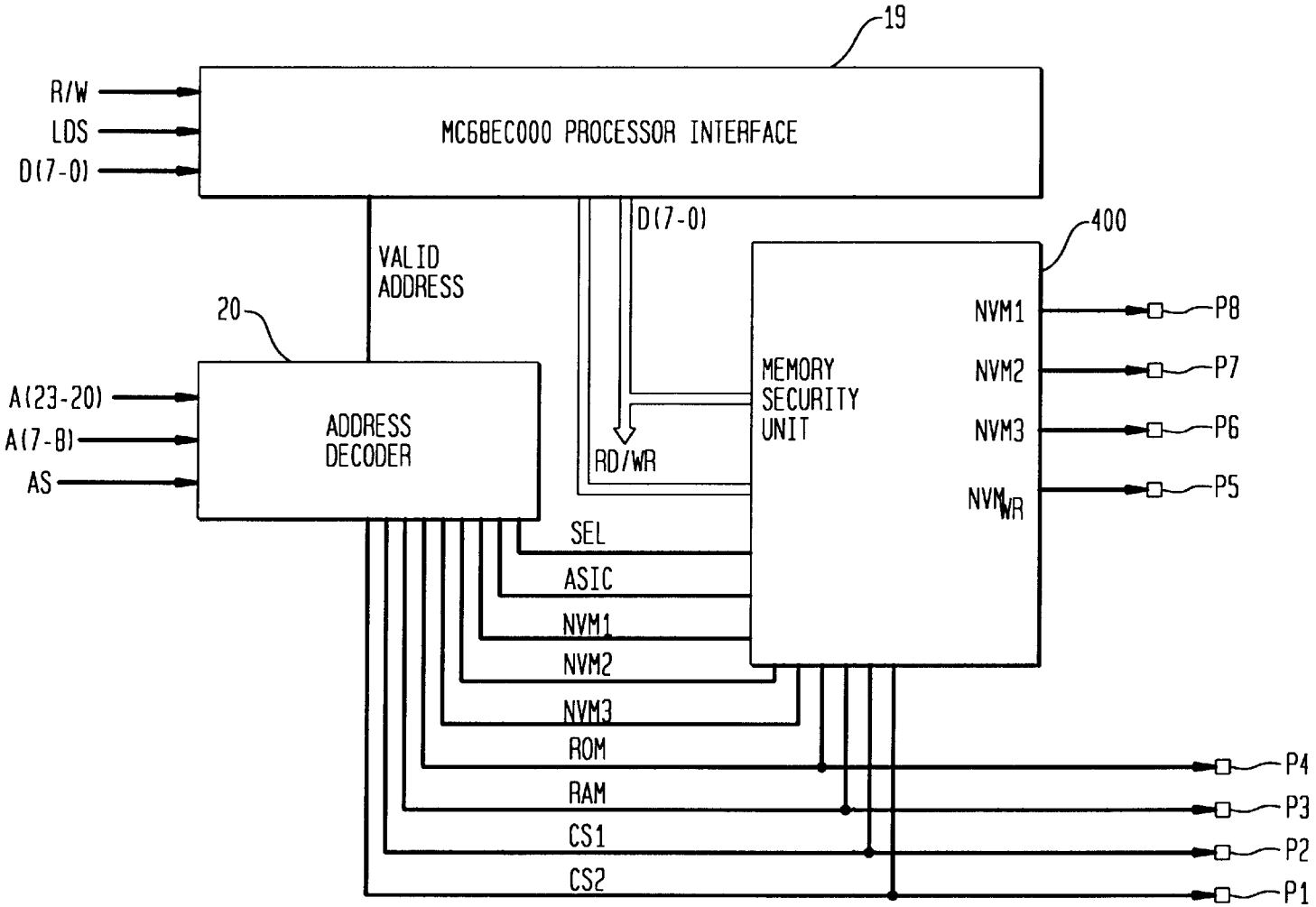
FIG. 2 is a partial schematic of the ASIC address decoder unit and ASIC NVM security unit in accordance with the present invention.

Referring to FIG. 2, the microprocessor 13 communicates the read/write (R/W) control signal, low data strobe (LDS) control signal, address strobe (AS) control signal, data bus lines D(7–0) and address lines A(7–0, 23–20) to the input side of the ASIC 15. The R/W, LDS and data signals (D7–0) are received by a microprocessor interface circuit 19. The processor interface circuit 19 performs a number of interface functions with the microprocessor. Those function relevant to the present invention will be described subsequently. The address lines and the AS signal from the microprocessor 13 are received by the address decoder circuit 20 of the ASIC 15.

The address decoder circuit 20 outputs a number of memory access control signals directed to the memory security unit 400. Particularly, the address decoder 20 directs the ROM and RAM chip select signals to the ASIC pins P3 and P4. The address decoder 20 also directs chip select signals CS1 and CS2 to ASIC pins P2 and P1. In the preferred embodiment of the present invention, the chip select signals CS1 and CS2 are provided in order to control memory access to external memory devices (not shown). Each of the chip select signals, RAM, ROM, CS1 and CS2 are also directed to the input side of a NVM security controller circuit 400 of the ASIC 15. Further directed to the input side of the NVM security controller circuit are the select signal (SEL), read signal (RD), write (WR), ASIC internal memory assess select signal (ASIC), NVM1 select, NVM2 select and NVM3 select signals from the address decoder 20.

Figure 3:
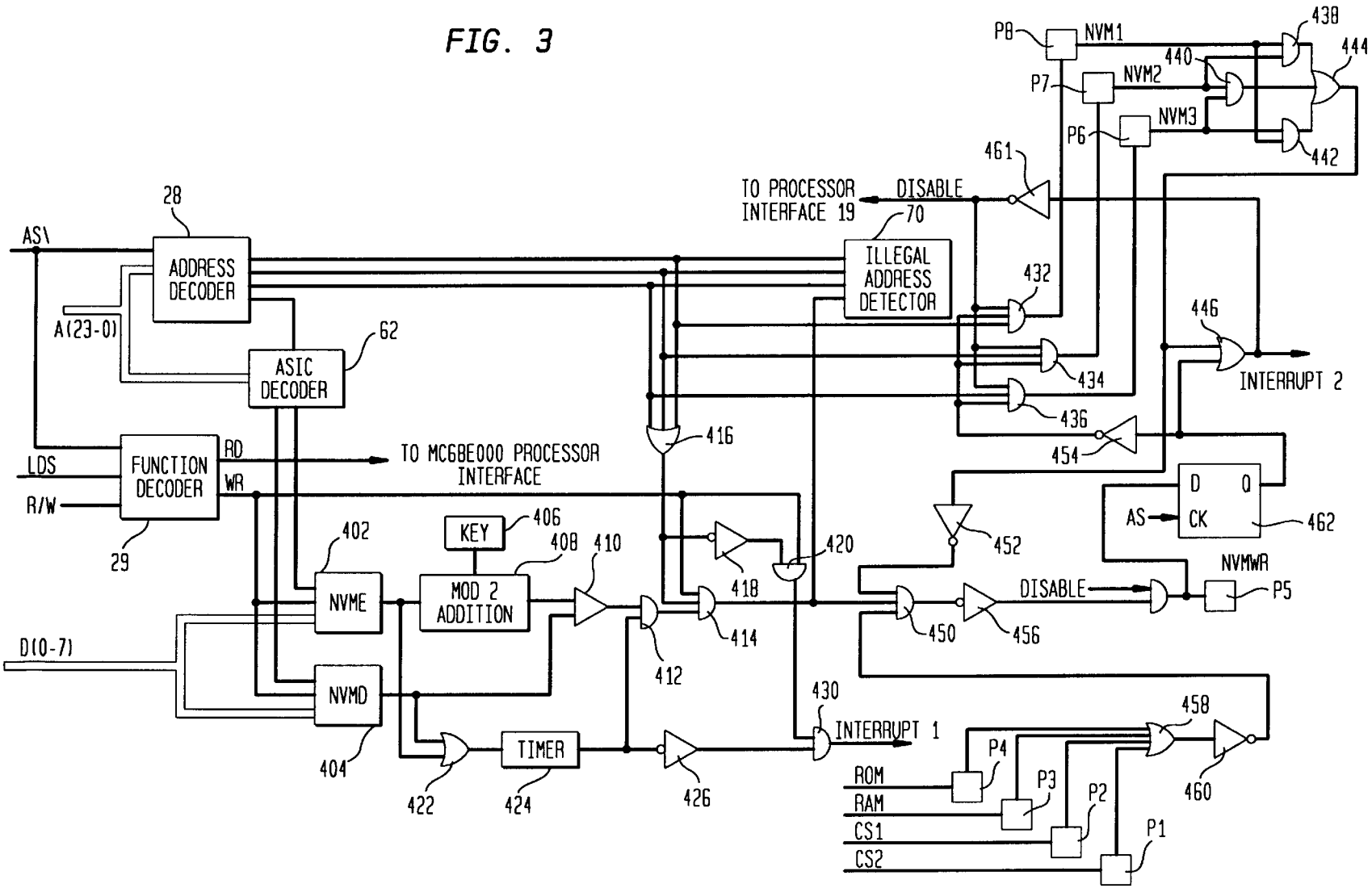
FIG. 3 is a logic schematic of the ASIC memory access and memory security system with memory monitoring in accordance with the present invention.

Referring to FIG. 3, the address decoder circuit includes an address decoder 28, an ASIC decoder 62 and a function decoder 29 which decoders will be here functionally described only to the extent relevant to the present invention. The address decoder 28 receives an AS strobe signal and address lines A(0–23) from the microprocessor. The function decoder 29 receives the AS strobe signal, LDS strobe and R/W enable signal. The NVM security circuit 400 includes an illegal address detector circuit 70, more particularly described in U.S. patent application Ser. No. 08/163,774, commonly assigned and here incorporated by reference now issued as U.S. Pat. No. 5,377,264.

A NVME register 402 and NVMD register 404 are also provided which receive input from data lines D(7–0), the function decoder 29 and ASIC decoder 62. The output from the NVME 402 is directed to a decryption circuit which needs a secret key from key register 406 and decrypts in the MOD 2 addition circuit 408. The decrypted output from the MOD 2 is compared by the comparator 410 with the encrypted data written to the NVMD register 404. Briefly here described, the data placed on D(7–0) is encrypted by the programmable microprocessor to have a specific relation to the decryption of that data by the Mod 2 Addition circuit. If that relationship is detected by the comparator 410, the output of the comparator 410 go active and is gated through gates 412, 414 and 450 to activate the NVMWR pin P5 of the ASIC under the proper condition subsequently described. The presence of the address strobe signal AS which initiated the sequence of events previously described at flip-flop 462 holds the flip-flop 462 output inactive even in the presence of a valid NVMWR signal. If the NVMWR is externally activated without the presence of an address strobe AS signal the flip-flop 462 is caused to change state whenever AS is next enabled causing OR gate 446 to go active. If the OR gate 446 goes active the state of gate 461 goes inactive disabling gates 432, 434 and 436, which are also connected to the output of flip-flip 462 through gate 454, thereby disabling unauthorized memory access to the NVMs. The output of the OR gate 446 is also directed to the microprocessor interface unit 19 which communicates to the microprocessor the interrupt condition.

Referring, more particularly, to FIGS. 4A, 4B, 4C and 4D, during an normal write cycle, the write cycle is initiated at 950 by microprocessor 13 writing to ASIC registers to unlock the memory. The microprocessor 13 addresses decoder 28.

The address decoder 28 addresses the ASIC decoder 62 at 958. The address decoder 28 then addresses the NVME register 402 and the NVMD register 404 to receive data from the data lines 0–7 at 960. The function decoder 29 write-enables the NVME register 402 and NVMD register 404 to receive the data at 962. At this point the software encrypted information on data line (0–7) is written to NVME register 402 and NVMD 404 register at 464. Then at 965 the timer 424 is then initiated after the write to either NVME 402 or NVMD 404 and the OR gate 422 is activated. At 966 the encrypted data from the NVME register 402 is read and combined with the KEY, from the KEY register 406 and decrypt by the MOD 2 408 utilizing the KEY. At 468 the encrypted data is read from NVMD register 404 and compares with decrypted data from MOD 2 408 by 8 bit comparator 410. If the comparison is equal then the output from comparator 410 is set active at 972. If the comparison is not equal to a defined relationship at 970 then nothing occurs at 974. The inactive state occurs when spurious data is generated and written to the registers 402 and 404.

If a valid comparison is made at 970, the comparator 410 is activated at 972 and, at 976, the output of the comparator 410 is ANDed with the output of timer 424 at AND gate 412. At 978, an AND gate 414 ANDs the output from gate 412, WR signal from decoder 29 with the output from OR gate 416.

Subsequently, following activation of comparator 410, microprocessor 13 writes to one of the NVMs by addressing NVM1, NVM2 or NVM3 at 952. At 954 the address decoder 28 produces the appropriate NVM# signal (NVM1, NVM2 or NVM3) corresponding to the addressed NVM. Also the decoder 28 output address causes OR gate 416 to go active at 956. Also indicated at 950, the microprocessor 13 causes the function decoder 29 to produce a WR signal. OR gate 416 in turn activates gate 418. Then, address decoder 28 decodes the non-volatile memory address and activates gate 420 when the function decoder 29 generates WR signal, as described in 480 (refer to FIG. 4B). If, at 482, the timer is active then gate 426 is turned "OFF" and as a result, AND gate 430 is held "OFF" at 484. If, at 486, the timer is inactive, then gate 426 is turned "ON" at 488 causing AND gate 430 to turn "ON" and a "INTERRUPT TYPE 1" signal to be issued, indicating a time-out condition occurred, thereby prohibiting memory access.

Figure 4A:
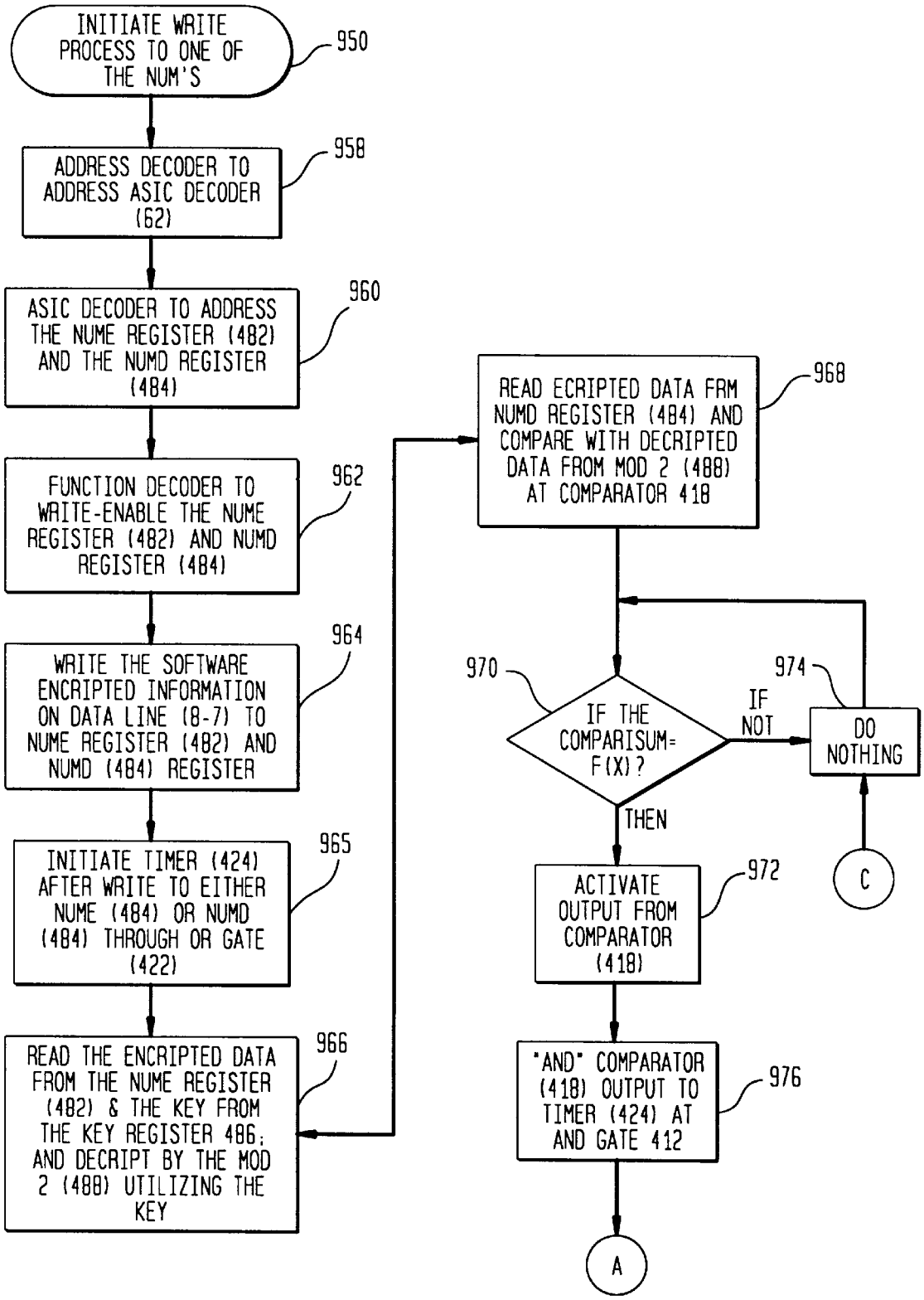
FIGS. 4A, 4B and 4C are logic diagrams for ASIC memory access in accordance with the present invention.
Figure 4B:
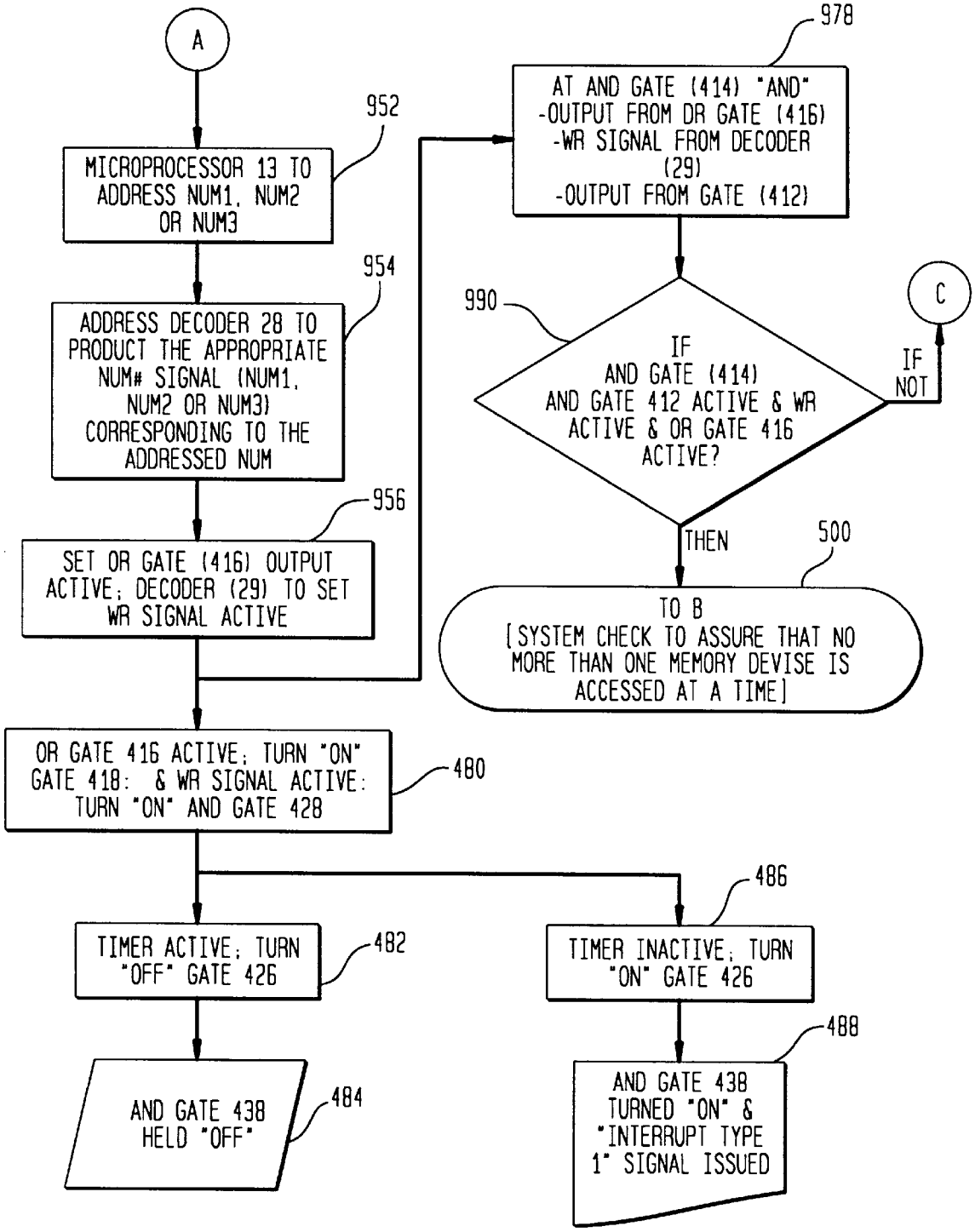

Referring to FIG. 4A, at 478, an AND gate 414 ANDs the output from gate 412, WR signal from decoder 29 with the output from OR gate 416. If, at 990, gate 412 is activating gate 414 active and WR is active and OR gate 416 is active, then the system proceeds to check to assure that no more than one memory device is accessed at a time at 500. If not, then the system returns to location 974.

Figure 4C:
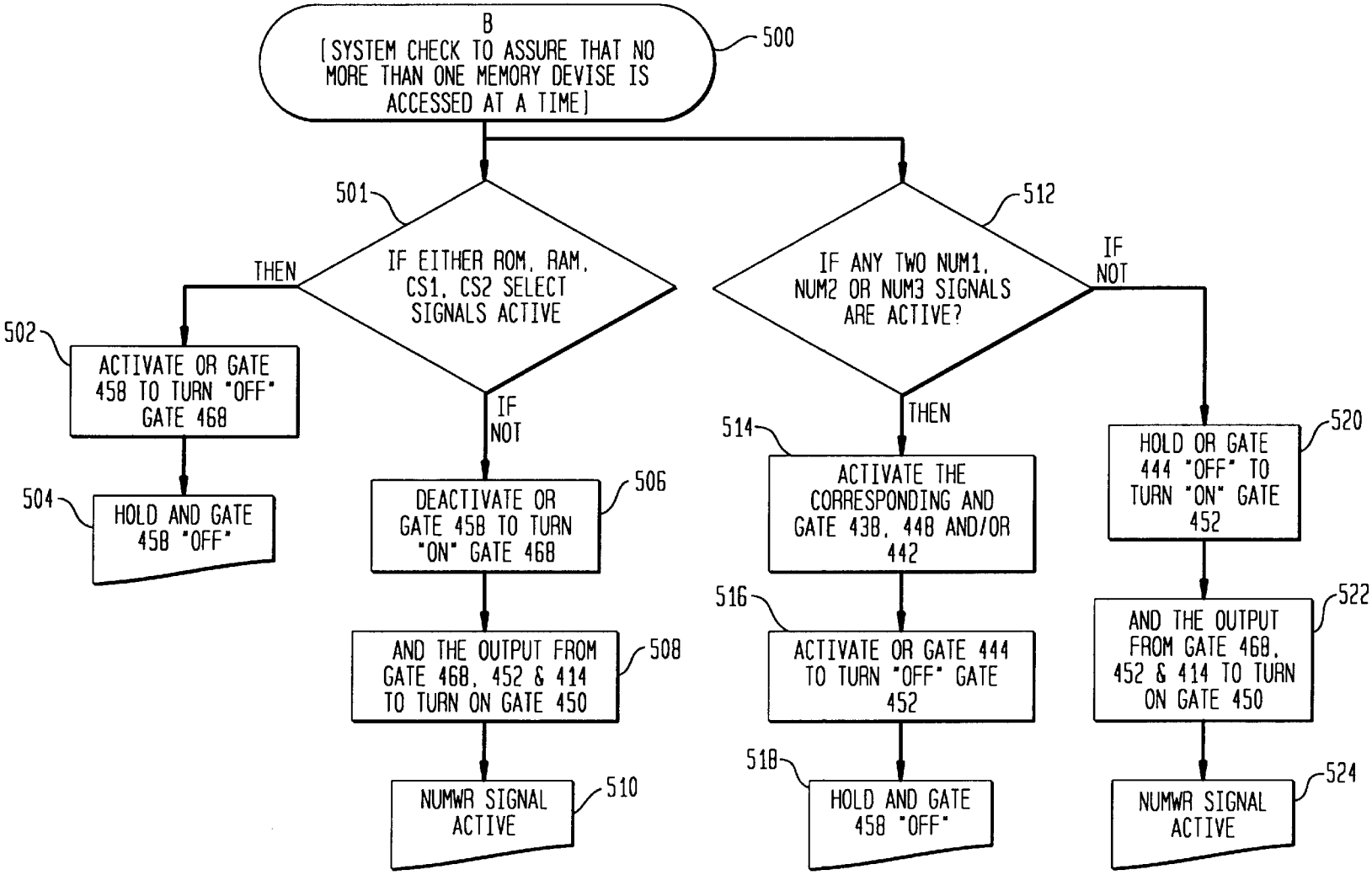

Referring to FIG. 4C, if, at 500, either ROM, RAM, CS1, CS2 select signals are active then OR gate 458 is activated to turn "OFF" gate 460 at 502 and hold AND gate 450 "OFF" at 504. This action prevents a non-volatile memory write enable signal from being issued. If, at 500, either the ROM, RAM, CS1, CS2 select signals are inactive, then OR gate 458 is activated to turn "ON" gate 460 at 506. At 508, the output from gate 460, 452 and 414 are ANDed to turn "ON" gate 456 resulting in the NVMWR signal going active at 510.

If, at 512, any two NVM1, NVM2 or NVM3 signals are active then the corresponding AND gate 438, 440 and/or 442 is set active at 514. OR gate 444 is then set active to turn "OFF" gate 452 at 516 which results in AND gate 450 being held "OFF" at 518. If, at 512, any two NVM1, NVM2 or NVM3 signals are not active then OR gate 444 is held "OFF" resulting in gate 452 being turned "ON" at 520. The output from gate 460, 452 and 414 are ANDed resulting in gate 456 being turned "ON" at 522. As a result the NVMWR signal is set active at 524.

Figure 4D:
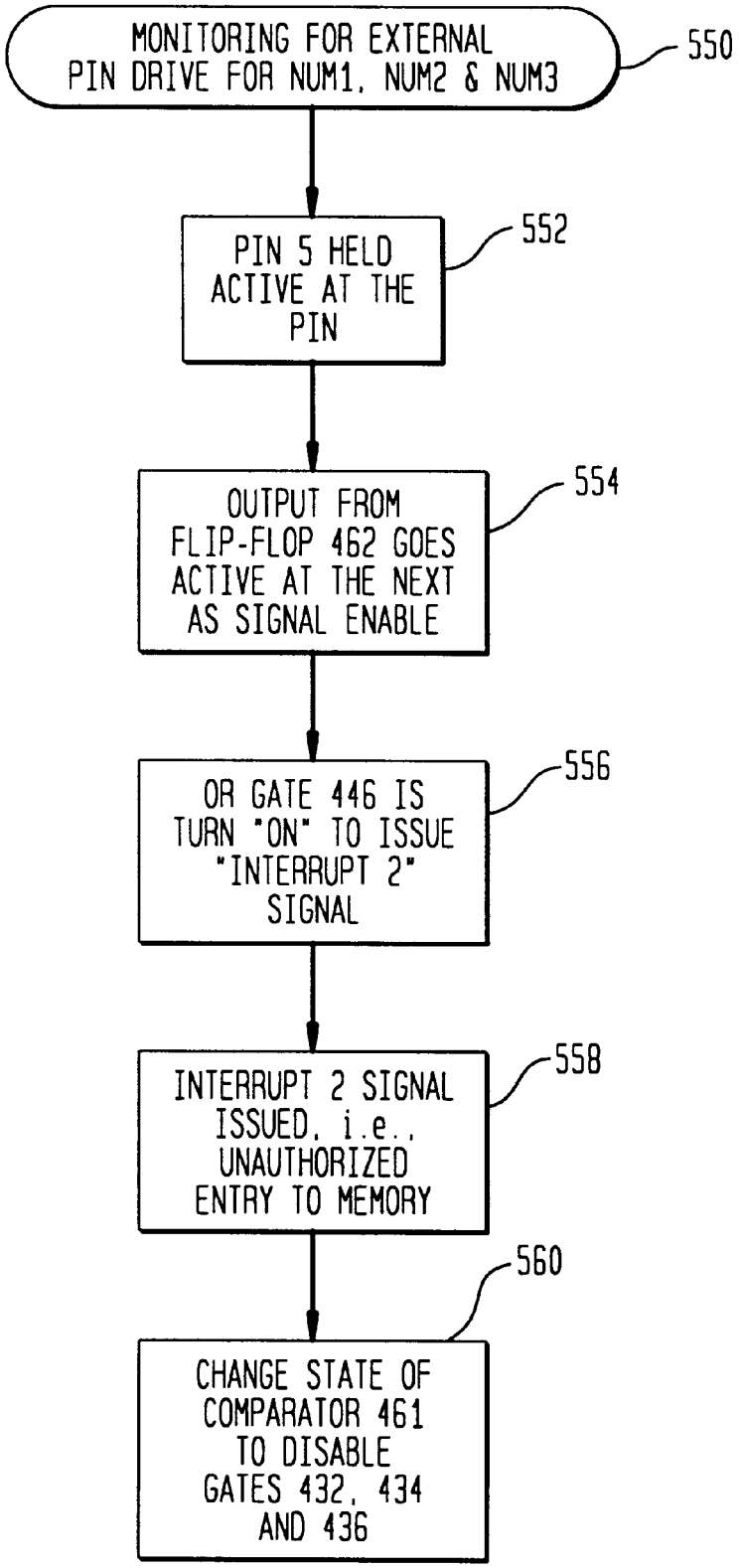
FIG. 4D is a logic diagram of the ASIC monitoring system in accordance with the present invention.

Referring to FIG. 4D, the system also monitors, at 550, the appropriate ASIC pins to assure that the pins for NVM1, NVM2 and NVM3 detect whether the pins are externally drive to gain unauthorized access to the memories. In order to gain access, both the NVMWR pin and one of the NVM pins P6, P7 or P8 must be held active. At 552, when pin 5 is externally activated without the presence of AS signal, the output from flip-flop 462 goes active at the next enabling of AS at 554. As a result, OR gate 446 is turned "ON" to issue "Interrupt 2" signal at 556. At 558, the "Interrupt 2" signal is recorded as an unauthorized entry to memory. Now at 560, the change of state of a gate 461 disables AND gates 432, 434 and 436, thereby disabling the meter NVM memory access.

Figure 5:
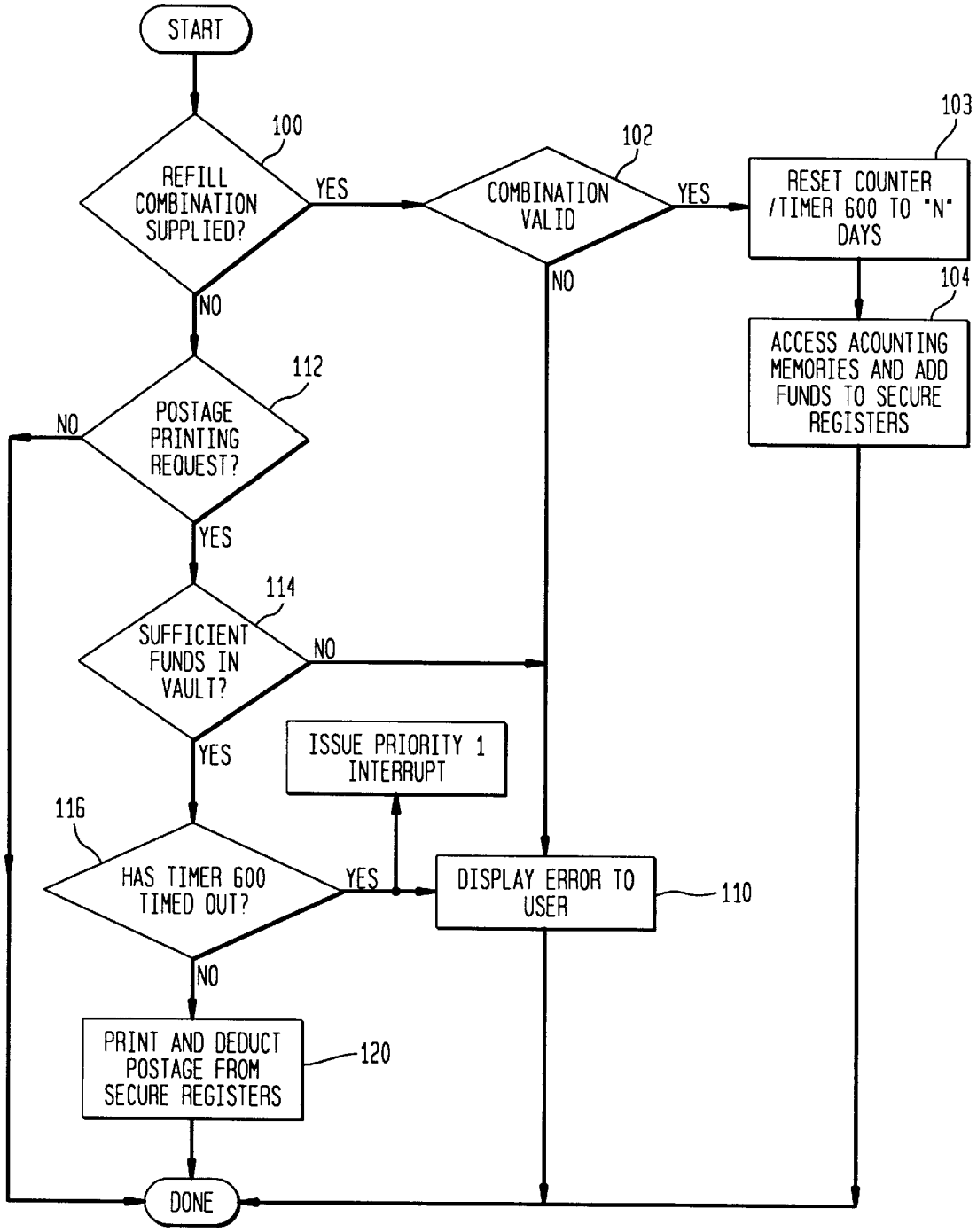
FIG. 5 is a logic chart of the mainline program for the postage metering system in a print mode and a recharge mode in accordance with the present invention.

FIG. 5 illustrates a software routine that controls the operation of meter 10. The routine commences with a determination as to whether a resetting combination has been inputted into the meter at step 100. If so, step 102 follows, at which it is determined whether the entered combination is valid. The determination of the validity of the combination may, for example, be as described in above referenced U.S. Pat. No. 4,097,923. If the combination was found to be valid, step 103 follows, at which the count down timer 600 is reset. Step 104 then follows, at which the previously described routine at 450 is initiated for the purpose of incrementing the descending register is incremented. The routine then ends. It is particularly noted that access to the secure accounting memories is not provided until timer 600 reset is completed.

If at step 102 the combination was found not to be valid, an error message will be displayed through user interface 30 at step 110 and the routine then ends.

If at step 100 a resetting combination was not input, step 112 follows, at which it is determined whether postage printing is requested. If not, the routine ends. If postage printing is requested, it is next determined, at step 114, whether there are sufficient funds in the vault, i.e., whether the descending register has a reading sufficiently high to permit printing of the requested postage amount at step 114. If there are not sufficient funds, an error message is displayed at step 110 and the routine ends. If there are sufficient funds at step 114, then at step 116, a check is performed to see if timer 600 has timed out. If the timer 600 has timed out, then an error is displayed to the user at step 110 and the routine ends. If the timer 600 has not timed out, then step 120 follows, at which the meter prints postage through print mechanism 24 and then updates the secure registers in the non-volatile memory unit MU by adding the amount of postage dispensed to the ascending register and subtracting that amount from the descending register. The routine then ends.

The metering system advantageously also includes a routine for testing whether the time deadline will soon be reached and displaying a warning of this fact. Additional steps to accomplish these functions may readily be inserted, for example between steps 116 and 120 of FIG. 2.

It is observed that the security process for accessing the non-volatile memories is quite elaborate in order to protect the non-volatile memory from receiving unintended data with the potential of corrupting the accounting data. The present invention provides an improved system of providing a time lock-out without endangering the security to the non-volatile memories.

What is claimed is:

1. An improved metering system having:

a microcomputer in bus communication with a program memory and secure non-volatile memory units an integrated circuit means having an address decoder module, interrupt controller module, printer controller module, said interrupt controller module and printer controller module being responsive to control signals from said address decoder wherein said improvement comprises:

said interrupt controller having a priority interrupt signal output signal which when activated causes microprocessor to execute a meter disabling routine to prevent printing of postage, a count down timer in communication with said interrupt controller having reset means for resetting said count down timer prior to said count down timer timing out and having means for causing said interrupt controller to output said priority interrupt signal when said count down timer has timed out, said resetting means further for controlling access to said secure memories, input means for receiving a combination, and means for comparing said combination with a corresponding combination stored in said secure memories, and wherein if said combination and said corresponding combination are found valid by said comparing means, then said reset means first resets said count down timer and subsequently enables access to said secure memories.

2. An improved system as claimed in claim 1 wherein said combination is encrypted comprising information representative of funding information.

3. An improved system as claimed in claim 2 wherein said means for comparing compares means for decrypting said encrypted combination.

4. An improved system as claimed in claim 3 further comprising digital printing means responsive to said microprocessor except when said microprocessor has disabled the meter.

5. An improved system as claimed in claim 4 wherein said integrated circuit further comprising a memory security module for prohibiting said input means for accessing said secured memory means except in response to said output signal from said comparison means.

* * * * *